US010787291B2

(12) United States Patent
Steward et al.

(10) Patent No.: US 10,787,291 B2
(45) Date of Patent: Sep. 29, 2020

(54) TRANSPORT PALLET AND MESH

(71) Applicant: GAPRIE LIMITED, Tauranga (NZ)

(72) Inventors: Jennifer Steward, Tauranga (NZ); Gary Wilson Priestley, Tauranga (NZ)

(73) Assignee: GAPRIE LIMITED, Tauranga (NZ)

( * ) Notice: Subject to any disclaimer, the term of this patent is extended or adjusted under 35 U.S.C. 154(b) by 59 days.

(21) Appl. No.: 16/153,907

(22) Filed: Oct. 8, 2018

(65) Prior Publication Data

US 2020/0108973 A1 Apr. 9, 2020

(51) Int. Cl.
*B65D 19/38* (2006.01)
*B65D 71/06* (2006.01)

(52) U.S. Cl.
CPC ..... *B65D 19/38* (2013.01); *B65D 71/063* (2013.01); *B65D 2519/00208* (2013.01); *B65D 2519/00711* (2013.01); *B65D 2571/00006* (2013.01); *B65D 2571/00691* (2013.01)

(58) Field of Classification Search
CPC ..... B65D 19/44; B65D 71/0088; B65D 71/02
USPC ..... 108/55.1, 55.5; 206/597
See application file for complete search history.

(56) References Cited

U.S. PATENT DOCUMENTS 1,365,511 A * 1/1921 Lee ..... B66C 1/127 294/77
1,966,893 A * 7/1934 Harris ..... B65D 71/0096 410/156
2,455,237 A * 11/1948 Davis ..... B60P 7/0876 410/97
3,011,820 A * 12/1961 Frieder ..... B66C 1/127 294/77
3,084,966 A * 4/1963 Higgins ..... B66C 1/127 294/77
3,173,539 A * 3/1965 Looker ..... B65D 63/14 206/597
3,312,181 A * 4/1967 Davidson ..... B60P 7/0823 410/97
3,945,493 A * 3/1976 Cardinal ..... B29C 61/0658 206/386
3,961,585 A * 6/1976 Brewer ..... B60P 7/0876 410/97
4,270,657 A * 6/1981 Bayon ..... B60P 7/0876 108/55.1
4,852,330 A * 8/1989 Carangelo ..... B60P 7/0876 53/399
4,868,955 A * 9/1989 Magnant ..... B65D 63/10 24/306
4,887,719 A * 12/1989 Kapke ..... B65B 11/025 206/597

(Continued)

*Primary Examiner* — Jose V Chen
(74) *Attorney, Agent, or Firm* — Dickinson Wright PLLC

(57) ABSTRACT

It is known to bind items to transport pallets by wrapping them in plastic film. However, this practice is time consuming, expensive and wasteful. It is an object of a preferred form of the invention to go at least some way towards addressing this. In the preferred embodiment there is a pallet containment mesh 2 wrapped around items stacked on a pallet 1, the mesh 2 comprising an upper entrance 4, a tightening mechanism 9 and elasticated ribs 8 extending from the entrance 4 to the pallet 1. The entrance can be tightened by the tightening mechanism to a substantially closed disposition so that items cannot be removed from the pallet and the elasticated ribs provide the stack with a stabilising tension.

7 Claims, 2 Drawing Sheets

(56) References Cited

U.S. PATENT DOCUMENTS

| | | | | | |
|---|---|---|---|---|---|
| 5,058,786 | A * | 10/1991 | Politi | B60P 7/0876 | 224/318 |
| 5,699,646 | A * | 12/1997 | Hammer | F26B 9/006 | 53/397 |
| 5,725,089 | A * | 3/1998 | Ravet | B66C 1/18 | 206/442 |
| 5,869,162 | A * | 2/1999 | Traa | B65D 19/44 | 294/77 |
| 7,070,373 | B2 * | 7/2006 | Brown | B60P 7/0876 | 410/97 |
| 7,448,836 | B2 * | 11/2008 | Clarke | B60P 7/0876 | 410/118 |
| 8,250,835 | B2 * | 8/2012 | Kenneally | B65D 19/38 | 150/154 |
| 9,162,805 | B1 * | 10/2015 | Testa | B65D 71/0096 | |
| 10,071,842 | B2 * | 9/2018 | Jones | B65D 77/061 | |
| D835,027 | S * | 12/2018 | Kim | D12/403 | |
| 2016/0251155 | A1 * | 9/2016 | Lato | B60P 7/04 | 410/98 |
| 2019/0322414 | A1 * | 10/2019 | Chan | B60P 7/0876 | |
| 2020/0024791 | A1 * | 1/2020 | Tobbe | B65D 85/68 | |

* cited by examiner

TRANSPORT PALLET AND MESH

FIELD OF INVENTION

A preferred form of this invention relates to a mesh for containing objects on a pallet.

BACKGROUND

Pallets are widely used for storing and transporting objects. They are useful because they enable machinery such as fork lifts to readily move heavy loads.

When objects are placed on a pallet, it is important that they are secure and will not fall off. If an object falls it may be damaged or do harm to nearby people. To address this, it is known to bind the objects to a pallet by wrapping them in plastic film. There are problems with this approach. For example, wrapping can be a time-consuming process and the plastic typically needs to be cut open to access the objects afterwards. The plastic film is typically for single use and once unwrapped it is discarded. This leads to undesired expense in the long term, and contributes to workplace waste and the global plastic crisis.

OBJECT OF THE INVENTION

It is an object of a preferred embodiment of the invention to go at least some way towards addressing at least some of the above shortcomings. While this applies to preferred embodiments, it should be understood that the object of the invention per se is simply to provide the public with a useful choice. Therefore, any objects applicable to preferred embodiments should not be taken as a limitation on the scope of claims expressed more broadly.

DEFINITIONS

The terms "comprises" or "comprising" or derivatives thereof should not be interpreted as limiting. For example, if used in relation to a combination of features they should be taken to indicate that optionally, but not necessarily, there may be additional features not been mentioned.

SUMMARY OF THE INVENTION

According to one aspect of the invention there is provided a transport pallet supporting one or more items, wherein a retaining mesh extends around the item(s) and is fixed to the pallet, the mesh having an upper entrance, tightening means and elasticated ribbing, wherein:

- the entrance is maintained in a substantially closed disposition by the tightening means such that the item(s) cannot be removed from the pallet; and
- the ribbing extends upright between the entrance and the pallet to provide a vertical tension on the mesh to retain or substantially assist in retaining the item(s) on the pallet.

Optionally the mesh is fixed to the pallet by ties at a lower end of the mesh, wherein each tie passes behind a respective corner of the pallet and attaches to the mesh to provide a loop.

Optionally the entrance has an elasticated cord around its perimeter that is tensioned to bias the entrance towards a closed disposition.

Optionally there is a generally horizontal elasticated cord around a lower end of the mesh that is tensioned to provide an inwards pressure on the pallet and/or item(s).

Optionally there are four upright elasticated ribs that extend between the entrance and pallet, each one being at or immediately adjacent a respective corner of the pallet.

Optionally the mesh is in the form of a sleeve.

Optionally the pallet and item(s) are such that at the same time—

- the items are stacked on the pallet;
- the mesh has an elasticated base rib or base ribs extending generally horizontally to assist in providing tension between the mesh and the stack;
- the entrance has a generally horizontal elasticated upper rib or ribs at its perimeter that naturally bias the entrance towards a closed disposition;
- there is a thread at the entrance that adjustably pulls the entrance into the closed disposition and that can be released to open the entrance;
- the bottom of the mesh has a series of elasticated ties arranged such that each tie passes behind a respective corner of the pallet and attaches to the mesh to provide a loop;
- the mesh is in the form of a sleeve.

DRAWINGS

Some preferred embodiments of the invention will now be described by way of example and with reference to the accompanying drawings, of which:

DETAILED DESCRIPTION

Figure 1:
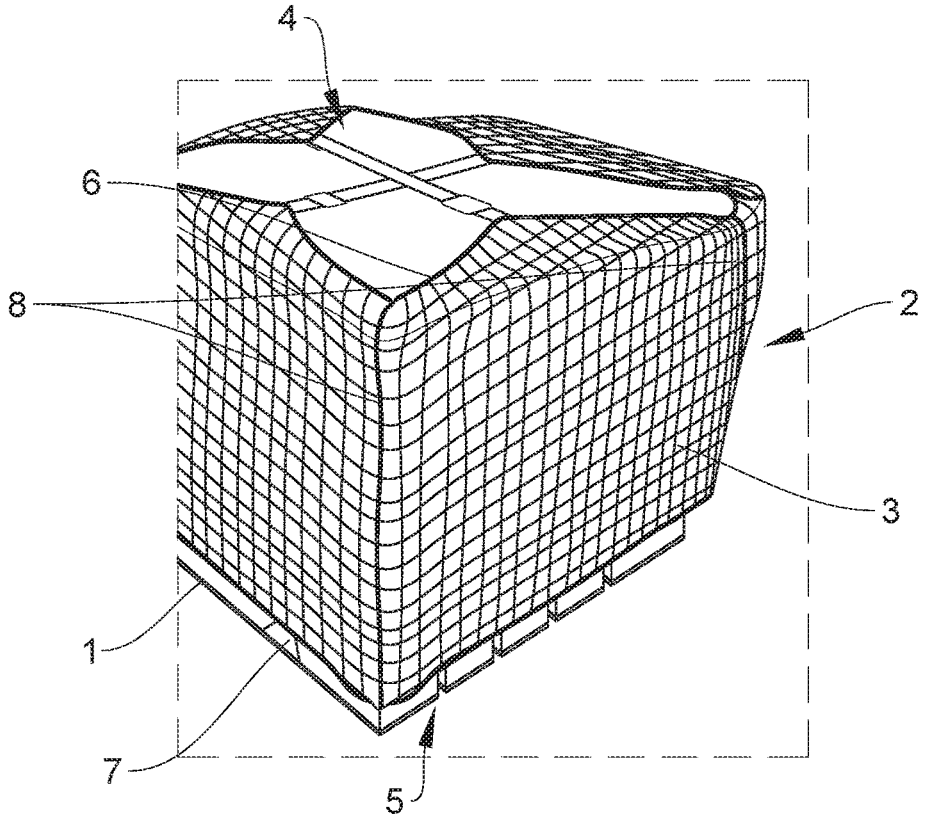
FIG. 1 is an isometric view of a pallet and containment mesh in use.

Referring to FIG. 1, there is a pallet 1 with boxes stacked on it. The boxes are secured to the pallet 1 by a pallet containment mesh 2. More particularly, the mesh 2 is net-like and is wrapped around at the boxes such that they are secured to the pallet.

Preferably the mesh 2 is formed from 4 mm or 5 mm thick polypropylene threads and its openings are about 50 mm by 50 mm. However it should be appreciated that other materials and sizes can be used.

The mesh 2 has an upper opening 4 and a lower opening 5. The upper opening 4 has an elasticated perimeter cord 6 the whole way around. The lower opening 5 also has an elasticated cord 7 extending completely around its perimeter. The mesh is formed so that when considered on its own, ie when not in use, it is open at both ends. In other words it is generally sleeve-like.

The mesh 2 incorporates four vertical elasticated ribs in the form of cords 8. These are evenly spaced and each extend from the upper cord 6 to the lower cord 7. The upper and lower cords 6, 7 help create tension around the boxes to stabilise the stack by substantially restricting sideways movement of the boxes. Similarly, the vertical cords 8 create a vertical tension that also helps stabilise the stack by restricting sideways movement of the boxes. The collective tension of the upper, lower and vertical cords 6, 7, 8 means that the mesh 2 secures the boxes to the pallet 1 even when the size of the stack changes somewhat.

The elasticated cords 6, 7, 8 are preferably formed from 4 mm gauge rubber threaded extrusion from natural round latex, however it should be appreciated that suitable alternative materials and thicknesses may be used, depending on the size of the pallet and the load it is carrying.

Figure 2:
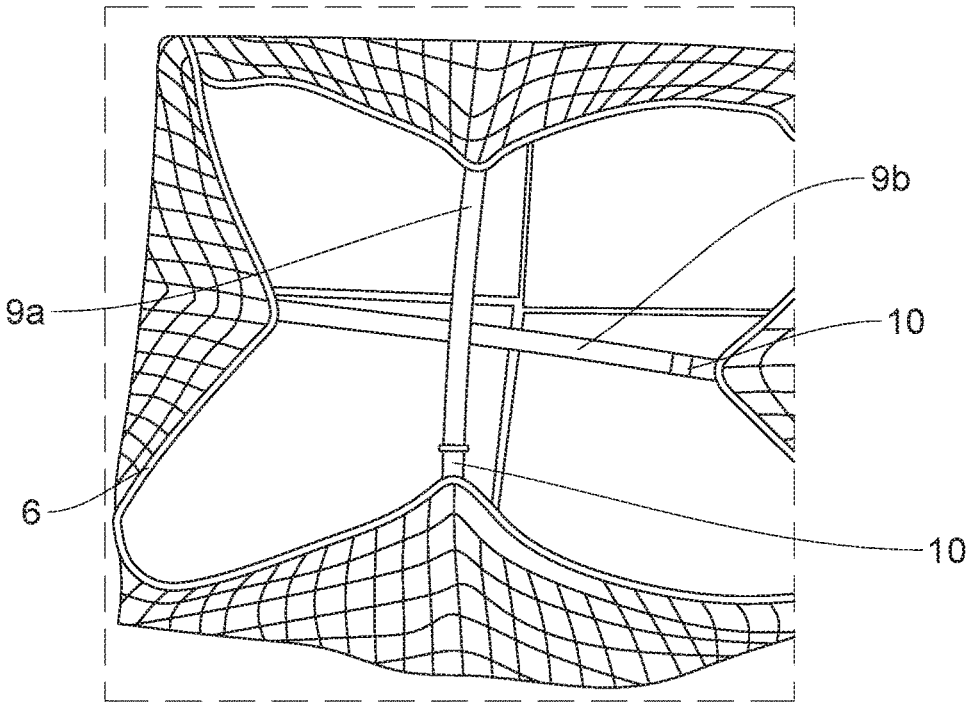
FIG. 2 is a top down view of the pallet and mesh.

Referring to FIG. 2, the upper opening 4 has two tightening straps 9 arranged to cross one another. As shown, each strap 9 extends from one side of the opening 4 to the other. Each of the straps 9 is attached to the upper cord 6 and has a buckle 10. In the embodiment shown, the straps 9 are sewn to the upper cord 6. In alternative embodiments the straps are attached to 'D' rings that are attached to the perimeter of the upper opening. The straps 9 are arranged such that when tightened, they create further tension at the upper cord 6, so that the boxes are secured against moving or falling off the pallet 1.

When the straps 9 are tightened the upper opening 4 is closed (e.g. reduced in size) and the boxes cannot be removed through that opening. To access the boxes, the buckles 10 are manipulated and the straps loosened. The opening 4 is then expanded and one or more of the boxes can be taken from the pallet. The straps 9 are then tightened to secure the remaining boxes on the pallet once more.

Figure 3:
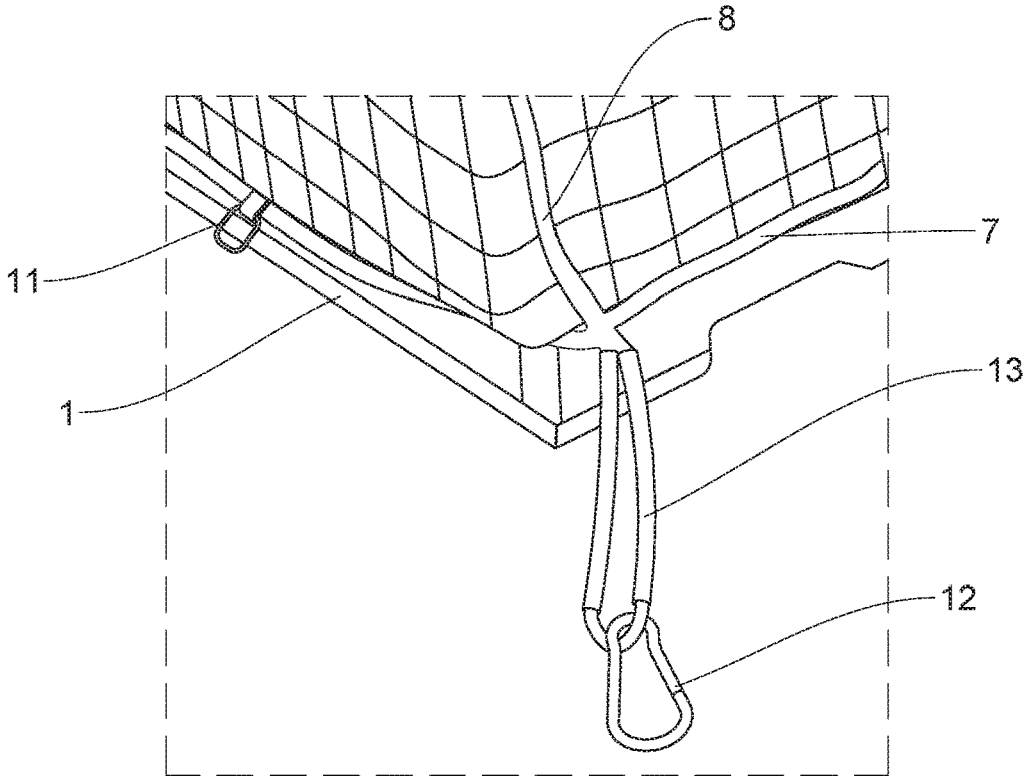
FIG. 3 is an isometric view of lower portions of the pallet and mesh.

Referring to FIG. 3, there is a 'D' ring 11 attached to the lower cord 7 between each pair of neighbouring vertical cords 8. In a preferred embodiment, there are two 'D' rings spaced between neighbouring pairs of the cords 8. More particularly, there are two 'D' rings adjacent to one side of the pallet and two 'D' rings adjacent to an opposite side of the pallet. There is also a carabiner 12 attached to an elasticated base tie 13 at each lower corner of the pallet. As indicated, each base tie 13 extends from a junction of a corresponding vertical cord 8 and lower cord 7. Preferably each base tie 13 is formed from an elasticated cord.

Figure 4:
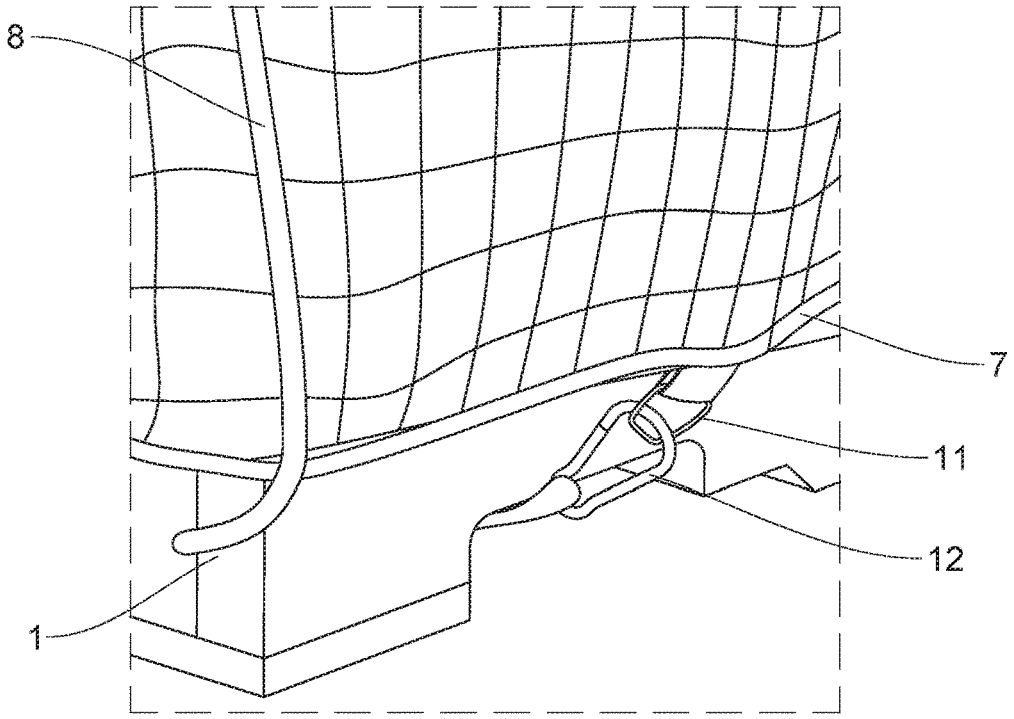
FIG. 4 is a further isometric view of the lower portions.

Referring to FIG. 4, the containment mesh 2 is secured to the pallet 1 by passing each base tie 13 and carabiner 12 behind a respective corner leg of the pallet 1 and clipping the carabiner to the closest D ring 11 at the by the side of the pallet to form a loop. The tie cord 13 provides for the loop in the manner described. This causes the lower end of the mesh 2 to be securely fastened to the pallet.

The mesh 2 can be any suitable size to accommodate the pallet and stack it is used with. The mesh 2 is adaptable in that it can stretch or relax to secure stacks of boxes of varying height, even after a layer of boxes has been added to or removed from the stack. In some embodiments, the mesh 2 can secure a stack even after up to 500 mm of height is removed from the stack e.g. if the mesh 2 secures a stack up to 1500 mm high, it will also secure the stack if it is reduced to 1000 mm in height. In other embodiments, the mesh 2 may secure stacks where more than 500 mm of height is removed from the stack.

While some preferred forms of the invention have been described by way of example, it should be understood that modifications and improvements can occur without departing from the scope of the following claims.

What is claimed is:

1. A transport pallet supporting a load, wherein a retaining mesh extends around the load and is fixed to the pallet, the mesh having a lower opening with an elasticated perimeter cord extending the whole way around the opening at the pallet, an upper entrance with an elasticated perimeter cord extending substantially horizontally the whole way around the upper entrance over the load, tightening means and elasticated ribbing, wherein:

the upper entrance is larger than any spacing within the mesh;

the mesh and ribbing extend onto a top surface of the load;

the upper entrance is maintained in a substantially closed disposition over the top of the load by the tightening means such that the load cannot be removed from the pallet; and the ribbing extends upright between the upper entrance and the pallet to provide a vertical tension on the mesh to retain or substantially assist in retaining the load on the pallet.

2. A transport pallet according to claim 1, wherein the mesh is fixed to the pallet by ties at a lower end of the mesh, wherein each tie passes behind a respective corner of the pallet and attaches to the mesh to provide a loop.

3. A transport pallet according to claim 1, wherein the elasticated cord at the upper entrance is tensioned to bias the entrance towards a closed disposition.

4. A transport pallet according to claim 1, wherein the elasticated perimeter cord at the lower opening is generally horizontal elasticated and is tensioned to provide an inwards pressure on the pallet and/or the load.

5. A transport pallet according to claim 1, wherein there are four upright elasticated ribs that extend between the upper entrance and the pallet, each one being substantially at a respective corner of the pallet.

6. A transport pallet according to claim 1 wherein the mesh is in the form of a sleeve.

7. A transport pallet according to claim 1, wherein:

the mesh is fixed to the pallet by ties at a lower end of the mesh, wherein each tie passes behind a respective corner of the pallet and attaches to the mesh to provide a loop;

the elasticated cord at the upper entrance is tensioned to bias the entrance towards a closed disposition;

the elasticated perimeter cord at the lower opening is generally horizontal and is tensioned to provide an inwards pressure on the pallet and/or load;

there are four upright elasticated ribs that extend between the entrance and the pallet, each one being substantially at a respective corner of the pallet; and the mesh is in the form of a sleeve.

* * * * *